US010352206B2

(12) United States Patent
Boese et al.

(10) Patent No.: US 10,352,206 B2
(45) Date of Patent: Jul. 16, 2019

(54) CAMSHAFT ADJUSTER

(71) Applicant: Schaeffler Technologies AG & Co. KG, Herzogenaurach (DE)

(72) Inventors: Olaf Boese, Nuremberg (DE); Jochen Thielen, Nuremberg (DE); Joachim Dietz, Frensdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/553,453

(22) PCT Filed: Feb. 8, 2016

(86) PCT No.: PCT/DE2016/200078
§ 371 (c)(1),
(2) Date: Aug. 24, 2017

(87) PCT Pub. No.: WO2016/141929
PCT Pub. Date: Sep. 15, 2016

(65) Prior Publication Data
US 2018/0045087 A1 Feb. 15, 2018

(51) Int. Cl.
*F01L 1/344* (2006.01)

(52) U.S. Cl.
CPC ... *F01L 1/3442* (2013.01); *F01L 2001/34426* (2013.01); *F01L 2001/34433* (2013.01);
(Continued)

(58) Field of Classification Search
CPC ..... F01L 1/3442; F01L 2001/34453; F01L 2001/34426; F01L 2001/34446; F01L 2001/34433; F01L 2001/34469
See application file for complete search history.

(56) References Cited

U.S. PATENT DOCUMENTS 5,704,317 A * 1/1998 Barth ..... F01L 1/34406 123/90.17
6,035,819 A 3/2000 Nakayoshi et al.
(Continued)

FOREIGN PATENT DOCUMENTS

CN 101918680 12/2010
CN 102713171 10/2012
(Continued)

OTHER PUBLICATIONS

International Search Report of PCT/DE2016/200078 dated May 30, 2016, 2015, 2 pages.

*Primary Examiner* — Mark A Laurenzi
*Assistant Examiner* — Wesley G Harris
(74) *Attorney, Agent, or Firm* — Davidson, Davidson & Kappel, LLC

(57) ABSTRACT

A camshaft adjuster including a stator, a rotor and a pressure medium supply, at least one chamber being formed on the stator, which is divided into two working chambers by at least one vane formed on the rotor or rotatably fixedly connected to the rotor is provided. A pressure medium is applicable to each of the two working chambers via the pressure medium supply in such a way that a pressure of the pressure medium may be increased in each of the working chambers to the extent that the pressure increase results in a rotation of the rotor. A switchable valve is formed in the vane of the rotor, which, in a first switching position of the valve, allows a flow of the pressure medium from a first working chamber through the vane into a second working chamber, in a second switching position the valve hydraulically separating the working chambers from each other. A locking element, which fixes the vane in a defined position with respect to the chamber, is designed to control an inflow or outflow of the pressure medium into or out of a working chamber. The pressure medium supply includes an oil pump,
(Continued)

a supply line connecting the oil pump to at least one of the working chambers and a hydraulic accumulator, which differs from the oil pump and the supply line.

17 Claims, 3 Drawing Sheets

(52) U.S. Cl.
CPC ..... *F01L 2001/34446* (2013.01); *F01L 2001/34453* (2013.01); *F01L 2001/34463* (2013.01)

(56) References Cited

U.S. PATENT DOCUMENTS

| | | | | |
|---|---|---|---|---|
| 7,222,597 | B2 * | 5/2007 | Auchter ..... | F01L 1/3442 123/90.15 |
| 8,833,318 | B2 | 6/2014 | Strauss et al. | |
| 8,763,574 | B2 | 7/2014 | Plate et al. | |
| 8,899,271 | B2 | 12/2014 | Busse et al. | |
| 9,506,380 | B2 | 11/2016 | Zschieschang | |
| 2010/0313834 | A1 | 12/2010 | Auchter et al. | |
| 2010/0326383 | A1 * | 12/2010 | Auchter ..... | F01L 1/34 123/90.15 |
| 2011/0088645 | A1 * | 4/2011 | Yamaguchi ..... | F01L 1/3442 123/90.17 |
| 2011/0114047 | A1 | 5/2011 | Hohmann et al. | |
| 2011/0259289 | A1 * | 10/2011 | Fujiyoshi ..... | F01L 1/3442 123/90.15 |
| 2013/0112161 | A1 * | 5/2013 | Fujiwaki ..... | F01L 1/3442 123/90.16 |
| 2013/0199470 | A1 * | 8/2013 | Schafer ..... | F01L 1/3442 123/90.15 |
| 2016/0024979 | A1 | 1/2016 | Busse | |
| 2016/0369663 | A1 * | 12/2016 | Zschieschang ..... | F01L 1/3442 |

FOREIGN PATENT DOCUMENTS

| | | |
|---|---|---|
| DE | 19903624 | 8/1999 |
| DE | 102004028868 | 1/2006 |
| DE | 102007056683 | 5/2009 |
| DE | 102012210795 | 9/2013 |
| DE | 102013204928 | 9/2014 |
| DE | 102013207615 | 10/2014 |
| DE | 102013211281 | 1/2015 |
| DE | 102013213132 | 1/2015 |
| EP | 2322769 | 5/2011 |
| EP | 2388446 | 11/2011 |
| EP | 2 478 189 B1 | 7/2012 |
| JP | H08247331 | 9/1996 |

* cited by examiner

CAMSHAFT ADJUSTER

The present invention relates to a camshaft adjuster for changing the control times of gas exchange valves on an internal combustion engine, including a stator, a rotor and including a pressure medium supply, at least one chamber being formed on the stator, which is divided into two working chambers by at least one vane formed on the rotor or rotatably fixedly connected to the rotor. A pressure medium is applicable to each of the two working chambers via the pressure medium supply in such a way that a pressure of the pressure medium in the particular working chamber may be increased to such an extent that the pressure increase results in a rotation of the rotor. A switchable valve is formed in the vane of the rotor, which, in a first switching position of the valve, permits the pressure medium to flow from a first working chamber, through the vane into a second working chamber, the valve hydraulically separating the working chambers from each other in a second switching position. A locking element, which fixes the vane in a defined position relative to the chamber, is designed to control an inflow or an outflow of pressure medium into/out of a working chamber.

BACKGROUND

A camshaft adjuster of this type including a central locking mechanism is already known from the prior art DE 10 2013 204 928 A1. In a camshaft adjuster of this type, the rotor is not only rotatable with respect to the stator within the chambers but is also fixable in a defined position, for example to make it easier to restart the engine. The chambers of the camshaft adjuster are supplied directly from an oil pump via a line. Relatively large and heavy oil pumps are required for this purpose to generate a sufficient volume flow to completely fill the enlarging working chambers in the camshaft adjuster with oil. If this does not take place, an underpressure may occur in the working chamber, whereby air is sucked into the camshaft adjuster. Due to the compressibility of air, the rotor is then no longer sufficiently hydraulically clamped in the chambers, so that vibrations may occur, which may impair the operation of the internal combustion engine and increase the consumption of the internal combustion engine and increase wear on the camshaft adjuster.

A camshaft adjuster is furthermore already known from the prior art, for example from EP 2 478 189 B1, in which a hydraulic accumulator is provided, a four-way valve being provided between the oil pump and the camshaft adjuster, which makes it possible to fill the chambers of the camshaft adjuster either directly via the oil pump or via the hydraulic accumulator. However, the disadvantage of this approach is that no central locking mechanism is provided.

SUMMARY OF THE INVENTION

It is an object of the present invention to eliminate the deficiencies known from the prior art in a camshaft adjuster and to refine a camshaft adjuster which includes a central locking mechanism in such a way that the efficiency is increased and pressure peaks are minimized.

The present invention provides that the pressure medium supply includes an oil pump, a supply line, which connects the oil pump to at least one working chamber, and a hydraulic accumulator, which differs from the oil pump and the supply line. As a result, a smaller oil pump may be used, and the risk of an underpressure occurring in a working chamber of the camshaft adjuster and air being sucked into the system thereby is greatly reduced. Due to the valves integrated into the vanes of the rotor, a hydraulic pass through the rotor may be activated in a first switching position of the valves, so that a hydraulic compensation between the two working chambers is possible, which facilitates the rotation of the rotor into a central position. The oscillating torques of the camshaft acting upon the camshaft adjuster may thus move the rotor by conveying the pressure medium from the one working chamber into the particular other working chamber of the chamber. This means that an adjustment of the rotor may take place via the oscillating torques of the camshaft without having to convey pressure medium in one of the working chambers by the oil pump, or the pressure built up by the oil pump uniformly acting upon both working chambers of a chamber. However, if the two working chambers of a chamber are separated by placing the valves into a second switching position, the particular first working chambers or second working chambers are connected to the hydraulic accumulator, so that the pressure medium is able to subsequently flow into the particular enlarging working chamber during a rotation of the rotor induced by oscillating torques. This safely prevents an underpressure from occurring in a working chamber and thus air being sucked in.

According to one preferred specific embodiment, it is provided that the pressure medium in the hydraulic accumulator is stored under a higher pressure with respect to the ambient pressure. A subsequent flow of the pressure medium into the working chambers of the camshaft adjuster is facilitated thereby. In addition, a harmful underpressure may be even more reliably avoided thereby, since an earlier and faster subsequent flow of pressure medium occurs, due to the increased pressure in the hydraulic accumulator.

According to one advantageous refinement, it is provided that the first working chamber is connected to the hydraulic accumulator in the second switching position of the valve in such a way that the first working chamber is filled from the hydraulic accumulator via a line in a first operating state, for example an adjustment in the "advance" direction. In this way, the working chamber being enlarged due to the oscillating torques acting upon the rotor may be easily filled from the hydraulic accumulator, without the oil pump having to convey additional pressure medium into the first working chamber. The pressure medium in the hydraulic accumulator may be stored under ambient pressure or under a pressure which is higher than the ambient pressure.

Alternatively or additionally, it is provided that the second working chamber is connected to the hydraulic accumulator in the second switching position of the valve in such a way that the second working chamber is filled from the hydraulic accumulator via a line in a second operating state, for example an adjustment in the "retard" direction.

According to one advantageous specific embodiment, at least two chambers, preferably three chambers, are formed on the stator, the at least two chambers each being divided into working chambers by a vane of the rotor. A rotor which includes multiple vanes is more stable with respect to imbalances and thus runs more "smoothly" than a rotor which includes only one vane. It is particularly advantageous if the hydraulic accumulator is connected to two of the at least two chambers via a shared line, the line branching in such a way that a first branch of the line including the first chamber is connected to the valve on a side facing the second working chamber of the first chamber, and a second branch of the line including the second chamber is connected to the valve on a side facing the first working chamber of the second chamber. The length of the line may be kept short thereby, and only a few lead-throughs must be provided for the line in the stator and/or in the rotor, which keeps the manufacturing costs low.

According to one advantageous refinement, it is provided that, in the second switching position of the valves, the first working chamber of the first chamber is hydraulically connected to the hydraulic accumulator, the pressure medium flowing out of the hydraulic accumulator into the first working chamber of the first chamber in a first operating state, in particular in an adjustment in the "advance" direction.

Alternatively or additionally, it is provided that, in the second switching position of the valves, the second working chamber of the second chamber is connected to the hydraulic accumulator in such a way that the pressure medium flows out of the hydraulic accumulator into the second working chamber of the second chamber in a second operating state, in particular in an adjustment in the "retard" direction. In this way, the particular working chambers may be supplied from the hydraulic accumulator via only one shared line in an adjustment in the "advance" direction as well as in an adjustment in the "retard" direction, whereby a relatively simple and cost-effective construction is made possible.

According to another advantageous refinement, it is provided that a check valve is provided in the vane. This prevents an uncontrolled outflow of pressure medium from a working chamber, so that a rotation counter to the desired rotation direction of the rotor is impeded.

According to another advantageous specific embodiment, it is provided that a line between the hydraulic accumulator and the chambers is situated in parallel to the supply line between the oil pump and the chambers. A particularly fast filling of the particular working chamber is made possible thereby during a desired rotation of the rotor, since pressure medium is able to flow in parallel from the hydraulic accumulator and from the pump into the working chamber.

BRIEF DESCRIPTION OF THE DRAWINGS

The present invention is explained below on the basis of preferred specific embodiments with reference to the appended figures. In the figures, the same components or components having the same function are identified by the same reference numerals.

DETAILED DESCRIPTION

Figure 1:
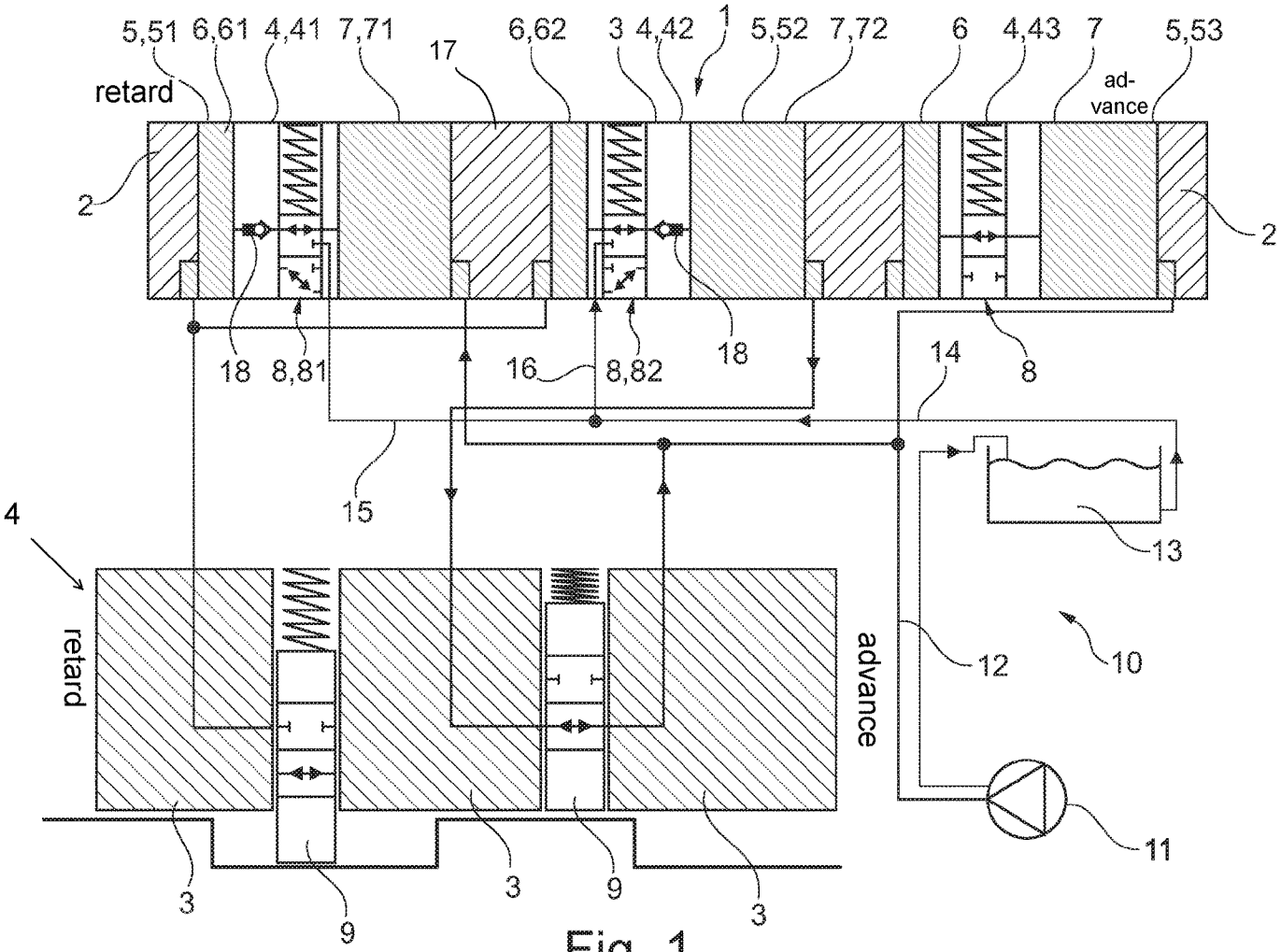
FIG. 1 shows a schematic function representation of a hydraulic camshaft adjuster according to the present invention.

A camshaft adjuster 1 according to the present invention, including a stator 2 and a rotor 3, is illustrated in FIG. 1. Webs 17 are formed on stator 2, which divide an annular space between stator 2 and rotor 3 into chambers 5, 51, 52, 53. In principle, a rotor 3 having only one chamber 5 is possible, however three or more chambers 5, 51, 52, 53 are preferably formed on rotor 3, as illustrated in FIG. 1. Chambers 5, 51, 52, 53 between stator 2 and rotor 3 are each divided into two working chambers 6, 7 by a vane 4, 41, 42, 43 of rotor 3, particular working chambers 6 on the left of vane 4 of rotor 3 in the figures being referred to as first working chambers 6, 61, 62, and the working chambers on the right of vane 4 in the figures being referred to as second working chambers 7, 71, 72. Switchable valves 8, 81, 82 are formed in each of vanes 4, 41, 42, 43 of rotor 3, valves 8, 81, 82 each being adjustable between at least two switching positions. In a first switching position of valves 8, 81, 82, working chambers 6, 61, 62, 7, 71, 72 are each hydraulically short-circuited, the pressure medium being able to flow through valves 8, 81, 82 or via one of locking elements 9 in vanes 4, 41, 42, 43 for the purpose of pressure compensation.

Camshaft adjuster 1 according to the present invention furthermore includes a pressure medium supply 10, which includes an oil pump 11, a supply line 12 and a hydraulic accumulator 13, which differs from oil pump 11 and supply line 12. When valves 8, 81, 82 are in the first switching position, supply line 12 may be connected to either working chambers 6, 61, 62 or working chambers 7, 71, 72. The connection to working chambers 7, 71, 72 is illustrated. Hydraulic accumulator 13 may be supplied with pressure medium via oil pump 11. Alternatively or additionally, it is provided that hydraulic accumulator 13 is filled with pressure medium flowing out of working chambers 6, 61, 62, 7, 71, 72 of camshaft adjuster 1 or with leakage oil. Hydraulic accumulator 13 is designed in a simple structure as a pressure medium reservoir, which is under ambient pressure. Alternatively, however, it is also conceivable that hydraulic accumulator 13 stores the pressure medium at a pressure which is higher than the ambient pressure to thereby facilitate a faster pressure medium supply of working chambers 6, 61, 62, 7, 71, 72. Hydraulic accumulator 13 may be integrated into the housing of camshaft adjuster 1 or be designed as a separate element. In the first switching position of valves 8, 81, 82, working chambers 6, 61, 62, 7, 71, 72 are separated from hydraulic accumulator 13, so that, in this switching position, hydraulic accumulator 13 does not influence the function of the hydraulic free flow between working chambers 6, 61, 62, 7, 71, 72. The connections between working chambers 6, 61, 7, 72 and hydraulic accumulator 13 may be opened and closed via valves 8, 81, 82.

Figure 2:
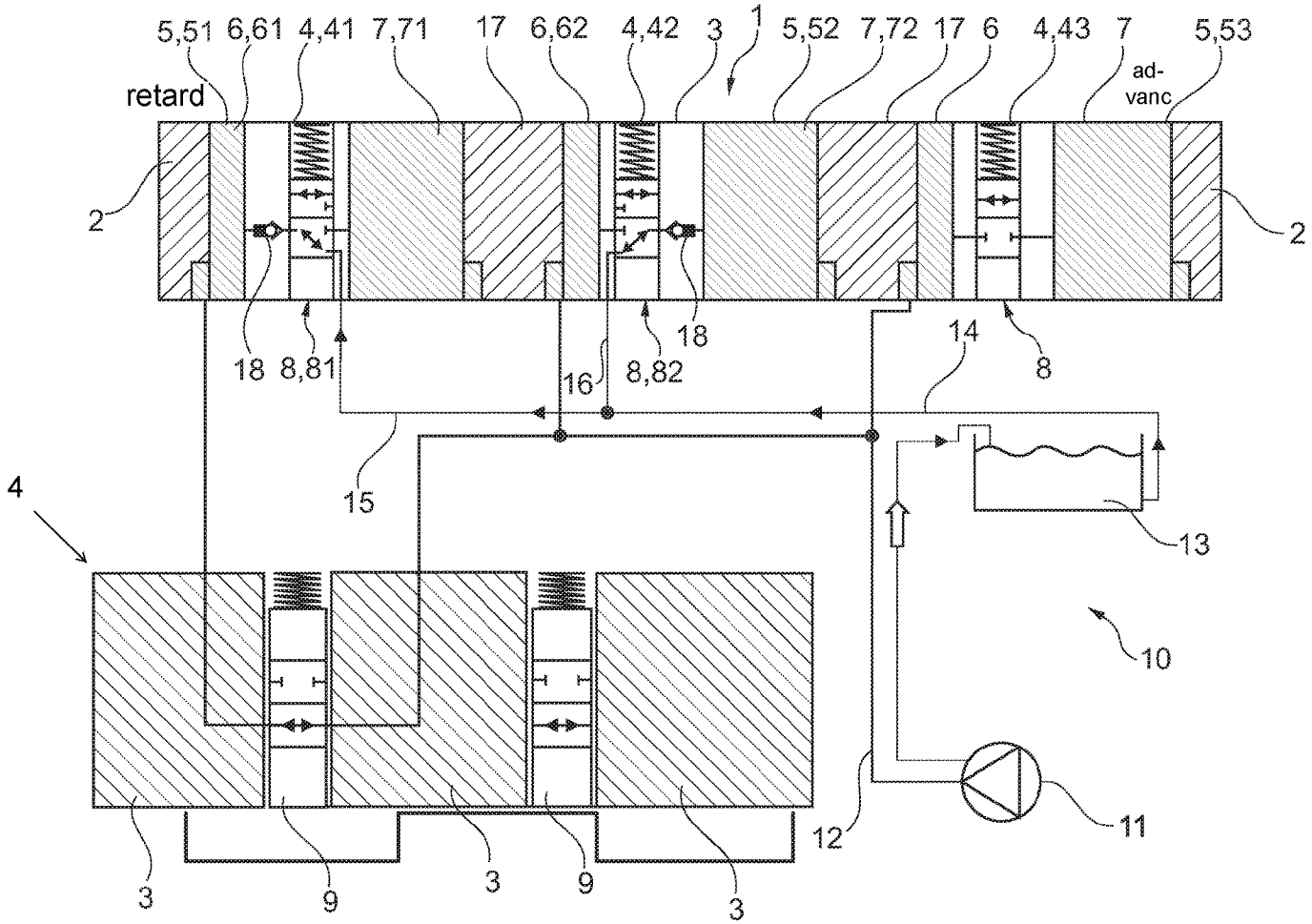
FIG. 2 shows the schematic function representation of the hydraulic camshaft adjuster according to the present invention in a second switching position.

Camshaft adjuster 1 from FIG. 1 is illustrated in a second switching position in FIG. 2. The design is basically identical, and only the differences are discussed below. Hydraulic accumulator 13 is connected to chambers 5, 51, 52 of camshaft adjuster 1 via a line 14, a first branch 15 of line 14 including first chamber 51 being connected to valve 81 on a side facing second working chamber 71 of first chamber 51, and a second branch 16 of line 14 including second chamber 52 being connected to valve 82 on a side facing first working chamber 62. An adjustment of rotor 3 in the "advance" direction induces an enlargement of particular first working chambers 6, 61, 62 and a reduction in the size of particular second working chambers 7, 71, 72. The pressure in first working chambers 6, 61, 62 is increased in such a way that a rotation of rotor 3 in the desired direction takes place due to the pressure. By adjusting valves 8, 81, 82 into a second switching position, working chambers 61 and 72 are now connected to hydraulic accumulator 13 via branches 15, 16 of line 14. Due to the oscillating torques acting upon the camshaft and/or due to an activation of pressure medium supply 10 via a central valve, which is not illustrated, camshaft adjuster 1 is adjusted in the "advance" direction. First working chambers 6, 61, 62 increase in size, so that an underpressure is able to form in particular working chambers 6, 61, 62 if insufficient pressure medium is supplied. Due to the pressure difference between hydraulic accumulator 13 and working chamber 61, pressure medium flows out of hydraulic accumulator 13 into working chamber 61 via line 14, in particular via first branch 15 of line 14, and valve 81. This prevents air from being sucked in by oil pump 11 if working chamber 61 is insufficiently supplied, which impairs the functionality of camshaft adjuster 1. To prevent pressure medium from flowing out of working chambers 6, 61, 62, 7, 71, 72, a check valve 18 is situated in particular vanes 4, 41, 42 of rotor 3. Check valve 18 in vane 42 prevents the pressure medium from flowing back out of working chamber 72, while check valve 18 in vane 41 is opened, due to the pressure difference between hydraulic accumulator 13 and working chamber 61, and enables the pressure medium to flow into working chamber 61.

Figure 3:
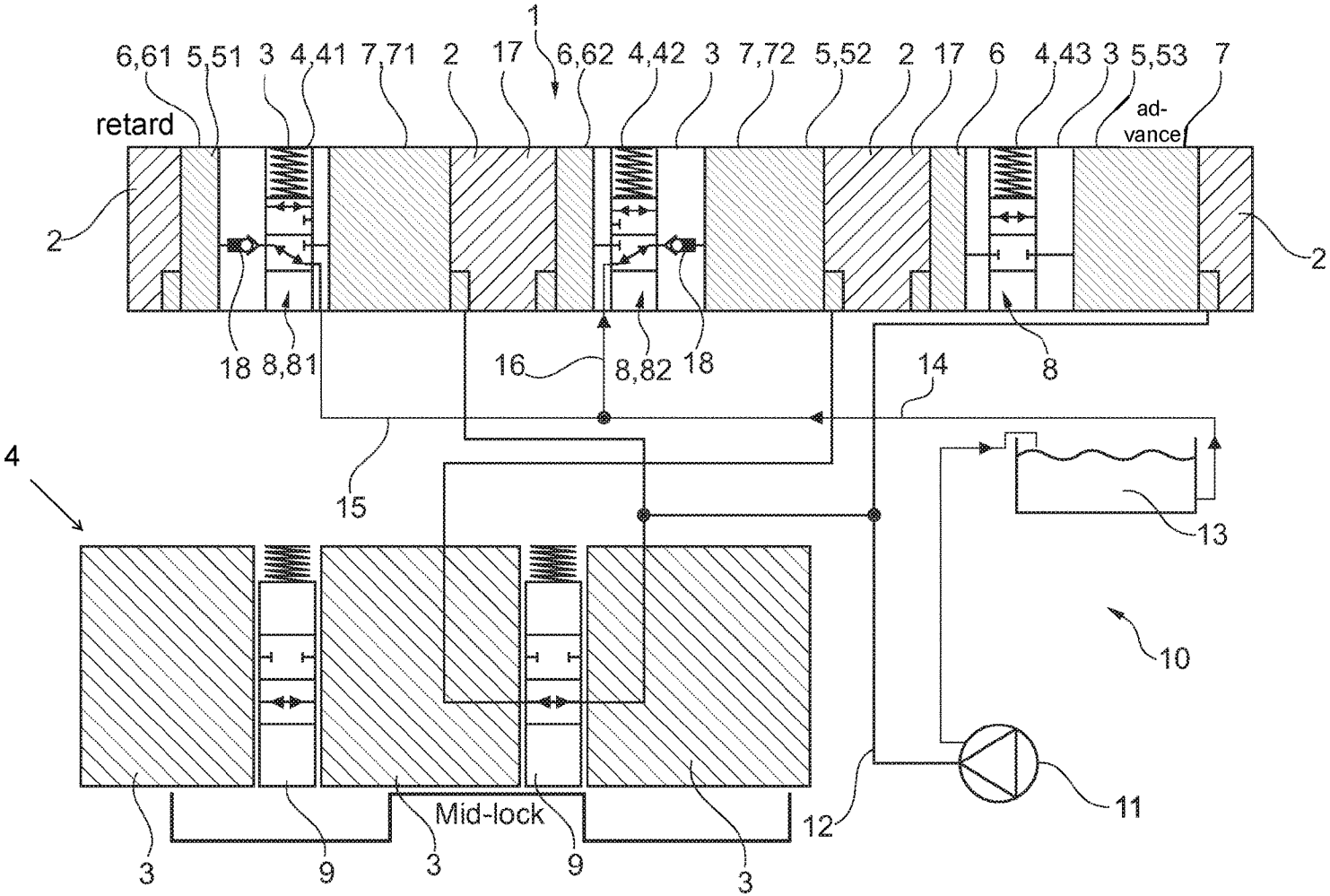
FIG. 3 shows the schematic function representation of the hydraulic camshaft adjuster according to the present invention in the second switching position in a different flow of the pressure medium.

FIG. 3 shows camshaft adjuster 1 from FIG. 1 in a second switching position and in another operating state, which differs from the operating state illustrated in FIG. 2. If camshaft adjuster 1 is adjusted in the "retard" direction, the volume of second working chambers 7, 71, 72 is increased, and the volume of first working chambers 6, 61, 62 is reduced, so that pressure medium must be supplied to second working chambers 7, 71, 72. In an adjustment in the "retard" direction, pressure medium flows out of hydraulic accumulator 13 into working chamber 72 via second branch 16 of line 14 and through valve 82, while working chambers 7, 71, which are increasing in size in parallel, are filled by oil pump 11 and supply line 12.

LIST OF REFERENCE NUMERALS

1 camshaft adjuster
2 stator
3 rotor
4 vane
5 chamber
6 first working chamber
7 second working chamber
8 valve
9 locking element
10 pressure medium supply
11 oil pump
12 supply line
13 hydraulic accumulator
14 line
15 first branch
16 second branch
17 web
18 check valve
41 first vane
42 second vane
51 first chamber
52 second chamber
53 third chamber
61 first working chamber
62 first working chamber
71 second working chamber
72 second working chamber
81 first valve
82 second valve

What is claimed is:

1. A camshaft adjuster comprising:

a stator;

a rotor;

a pressure medium supply;

at least one chamber being formed on the stator, the at least one chamber being divided into two working chambers by at least one vane formed on the rotor or rotatably fixedly connected to the rotor;

a pressure medium being applicable to each of the two working chambers via the pressure medium supply in such a way that a pressure of the pressure medium in a particular working chamber of the two working chambers is increasable so that a pressure increase results in a rotation of the rotor, the pressure medium supply including an oil pump, a supply line connecting the oil pump to at least one of the two working chambers, and a hydraulic accumulator different from the oil pump and the supply line;

a switchable valve being formed in the rotor, the switchable valve, in a first switching position of the valve, permitting the pressure medium to flow from a first working chamber of the two working chambers, through the rotor and the switchable valve into a second working chamber of the two working chambers without passing through the oil pump and the hydraulic accumulator, the valve hydraulically separating the first and second working chambers from each other in a second switching position; and a locking element fixing the vane in a defined position with respect to the at least one chamber, the locking element being designed to control an inflow or an outflow of pressure medium into or out of one of the two working chambers.

2. The camshaft adjuster as recited in claim 1 wherein an oil supply of the at least one chamber from the hydraulic accumulator takes place in the second switching position of the valve.

3. The camshaft adjuster as recited in claim 1 wherein the pressure medium in the hydraulic accumulator is stored under a higher pressure with respect to an ambient pressure.

4. The camshaft adjuster as recited in claim 1 wherein, in the second switching position of the valve, the first working chamber is connected to the hydraulic accumulator in such a way that the first working chamber is filled from the hydraulic accumulator via a line in a first operating state.

5. The camshaft adjuster as recited in claim 1 wherein, in the second switching position of the valve, the second working chamber is connected to the hydraulic accumulator in such a way that the second working chamber is filled from the hydraulic accumulator in a second operating state.

6. The camshaft adjuster as recited in claim 1 wherein at least first and second chambers of the at least one chamber, are formed on the stator, the first chamber being divided into the first and second working chambers by a first vane of the at least one vane, and the second chamber being divided into third and fourth working chambers by a second vane of the at least one vane; the hydraulic accumulator being connected to the first and second chambers via a shared line, the shared line branching in such a way that a first branch of the line is connected to the first chamber by the valve, and a second branch of the line is connected to the second chamber by a further valve.

7. The camshaft adjuster as recited in claim 6 wherein the at least one chamber includes a third chamber.

8. The camshaft adjuster as recited in claim 6 wherein, in the second switching position of the valves, the first working chamber of the first chamber is hydraulically connected to the hydraulic accumulator, the pressure medium flowing out of the hydraulic accumulator into the first working chamber of the first chamber in a first operating state.

9. The camshaft adjuster as recited in claim 6 wherein, in the second switching position of the valve or a second switching position of the further valve, the fourth working chamber of the second chamber is connected to the hydraulic accumulator in such a way that the pressure medium flows out of the hydraulic accumulator into the fourth working chamber of the second chamber in a second operating state.

10. The camshaft adjuster as recited in claim 1 further comprising a check valve is situated in the rotor.

11. The camshaft adjuster as recited in claim 10 wherein the check valve is situated in the vane of the rotor.

12. The camshaft adjuster as recited in claim 1 further comprising a line between the hydraulic accumulator and the at least one chamber is situated in parallel to the supply line between the oil pump and the chambers.

13. The camshaft adjuster as recited in claim 1 wherein the switchable valve is formed in the vane of the rotor, the switchable valve in the first switching position of the valve permitting the pressure medium to flow from the first working chamber through the vane into the second working chamber.

14. A camshaft adjuster comprising:

a stator;

a rotor;

a pressure medium supply;

at least one chamber being formed on the stator, the at least one chamber being divided into two working chambers by at least one vane formed on the rotor or rotatably fixedly connected to the rotor;

a pressure medium being applicable to each of the two working chambers via the pressure medium supply in such a way that a pressure of the pressure medium in a particular working chamber of the two working chambers is increasable so that a pressure increase results in a rotation of the rotor;

a switchable valve being formed in the vane of the rotor, the switchable valve, in a first switching position of the valve, permitting the pressure medium to flow from a first working chamber of the two working chambers, through the rotor into a second working chamber of the two working chambers, the valve hydraulically separating the first and second working chambers from each other in a second switching position; and a locking element fixing the vane in a defined position with respect to the at least one chamber, the locking element being designed to control an inflow or an outflow of pressure medium into or out of one of the two working chambers;

the pressure medium supply including an oil pump, a supply line connecting the oil pump to at least one of the two working chambers, and a hydraulic accumulator different from the oil pump and the supply line, wherein at least first and second chambers of the at least one chamber, are formed on the stator, the first chamber being divided into the first and second working chambers by a first vane of the at least one vane, and the second chamber being divided into third and fourth working chambers by a second vane of the at least one vane; the hydraulic accumulator being connected to the first and second chambers via a shared line, the shared line branching in such a way that a first branch of the line is connected to the first chamber by the valve, and a second branch of the line is connected to the second chamber by a further valve.

15. The camshaft adjuster as recited in claim 14 wherein the at least one chamber includes a third chamber.

16. The camshaft adjuster as recited in claim 14 wherein, in the second switching position of the valves, the first working chamber of the first chamber is hydraulically connected to the hydraulic accumulator, the pressure medium flowing out of the hydraulic accumulator into the first working chamber of the first chamber in a first operating state.

17. The camshaft adjuster as recited in claim 14 wherein, in the second switching position of the valve or a second switching position of the further valve, the fourth working chamber of the second chamber is connected to the hydraulic accumulator in such a way that the pressure medium flows out of the hydraulic accumulator into the fourth working chamber of the second chamber in a second operating state.

* * * * *